United States Patent [19]

Allen

[11] 4,072,581

[45] Feb. 7, 1978

[54] STRIPE ON STRIP PLATING METHOD

[75] Inventor: Robert M. Allen, Mill Valley, Calif.

[73] Assignee: National Semiconductor Corporation, Santa Clara, Calif.

[21] Appl. No.: 776,807

[22] Filed: Mar. 11, 1977

Related U.S. Application Data

[62] Division of Ser. No. 619,952, Oct. 6, 1975, Pat. No. 4,030,999.

[51] Int. Cl.[2] ..... C25D 5/02; C25D 7/06; C25D 5/08

[52] U.S. Cl. ..... 204/15; 204/28; 204/206

[58] Field of Search ..... 204/15, 206, 207, 28, 204/224 R

[56] References Cited

U.S. PATENT DOCUMENTS

| | | | |
|---|---|---|---|
| 1,899,449 | 2/1933 | Wallsten | 204/207 |
| 2,372,599 | 3/1945 | Nachtman | 204/206 |
| 3,644,181 | 2/1972 | Donaldson | 204/15 |

*Primary Examiner*—T. M. Tufariello

*Attorney, Agent, or Firm*—Gail W. Woodward; Willis E. Higgins

[57] ABSTRACT

An apparatus is described for selectively depositing a continuous stripe of one type of material on a strip of another type of material as the strip is transported through the apparatus on a path of spaced rails. The rails are provided for supporting the strip along its lateral edges. A weight or pressure in the form of a movable member is carried on the strip between tape-guiding means for forming a fluid-tight seal between the lateral edges of the strip and the rails. A plurality of fluid jets are provided in a line between the rails for jetting fluid against the strip. At opposite ends of the line of jets there is provided at least one fluid jet for jetting fluid inwardly against the back-spray of fluid from the strip for preventing the escape of spent fluid from between the rails and preventing plating in unwanted areas. Means are also provided for changing the width and position of the stripe on the strip by changing the relative position of the rails and strip-guiding means. For the electrodeposition of metal stripes, an electrode in the form of a wire mesh screen is employed between the jets and strip with means provided for providing an electrical potential between the screen and the strip.

3 Claims, 5 Drawing Figures

STRIPE ON STRIP PLATING METHOD

This is a division of application Ser. No. 619,952 filed Oct. 6, 1975 now U.S. Pat. No. 4,030,999.

BACKGROUND OF THE INVENTION

The present invention is related to deposition apparatus in general and, in particular, to plating apparatus for plating material continuously on a strip of another material as the strip is transported continuously through the apparatus.

In the connector industry, for example, it is frequently necessary to plate a strip of material with gold, silver or other metal prior to forming it into connectors. This is necessary for providing a suitable electric interface between the formed connector and a mating connector and for providing surfaces which are not subject to corrosion. This plating is required only at the interface and not in the balance of the connector. Also for the prevention of corrosion and for the making of surfaces having good and long-term electrical conductivity, gold and the like are frequently required to be plated on strips in the fabrication of electrical connectors and the like.

When strips of metal were first plated for use in the fabrication of connectors and lead frames, they were plated entirely by submersion in a plating bath or the like. This practice was wasteful of material and, as the price of metals increased, became very costly. Later, when selective plating of the strips became desirable, because of the waste and increased costs attending the prior methods, masking tape and rotating wheels with center slots of widths to mask the strip came to be employed.

The use of masking tape or the like for masking a strip, however, is time consuming and consequently still costly. This is because of the labor and materials involved in placing the tape on the strip and the cleaning of the adhesives used on the tape from the unplated surfaces of the strip after the strip is plated.

Rotating wheels used for plating stripes on strips comprise a center slotted section in which is mounted one or more fluid jets for spraying the desired plating material on the strip as the strip is transported over at least a portion of the periphery of the wheel.

In rotating wheel assemblies in which the fluid jets rotate with the wheel, there are problems of uniformity of the stripe especially when one of the jets is clogged.

In general, rotating wheel assemblies are expensive to tool and require idler rollers, backing webs and the like which are necessary to feed a strip through the assembly.

Another form of apparatus which has been employed in plating stripes on strips is one in which the strip is stepped through the apparatus. As in the rotating wheel assemblies, if any of the jets used for spraying the plating material on the strip becomes clogged, a non-uniform plating results. The stepping type plating apparatus is also relatively slow and, consequently, has a relatively low throughput.

SUMMARY OF THE INVENTION

In view of the foregoing, a principal object of the present invention is an apparatus for selectively continuously depositing a stripe of material on a strip of another material as the strip is transported through the apparatus.

A further object of the present invention is an apparatus for depositing stripes on strips which is reliable, provides a uniform stripe, and is relatively inexpensive and simple to operate.

Another object of the present invention is an apparatus for electrodepositing a metal stripe on a metal strip continuously as the strip is transported through the apparatus.

Still another object of the invention is an apparatus in accordance with the above objects in which there is a means for changing the width and position of a stripe plated on a strip without expensive tooling changes.

In accordance with the above objects, there is provided in a preferred embodiment of the present invention a pair of spaced rail members. The rails are provided for supporting the lateral edges of a strip being transported through the apparatus. For forming a fluid-tight seal between the strip and the rails, there is provided an elongated member which is caused to be carried on the upper surface of the strip. The weight of the member causes the strip to bear against the rails in a fluid-tight manner. Disposed between the rails and perpendicularly oriented relative to the strip is a plurality of fluid jets. At opposite ends of these fluid jets there is provided at least one fluid jet for jetting fluid inwardly against the back-spray of fluid from the intermediate jets. Thw inward fluid spray from the latter fluid jets is provided for preventing the escape of fluid to the outside of the apparatus from between the rails and preventing plating in the masked areas.

For the electrodeposition of a metal stripe on the strip, there is further provided an electrode which is mounted between the rails in a position between the strip and the jets. The electrode is a metal screen and is provided to be coupled to a source of potential for providing an electric field in the fluid from the jets between the metal screen and the strip.

As still another feature of the present invention, means are provided for adjusting the relative position of the rails and the position of a strip-guiding means relative to the rails for changing the width and position of a stripe on a strip.

DESCRIPTION OF THE DRAWINGS

A preferred embodiment of the present invention is shown in the accompanying drawings in which.

DETAILED DESCRIPTION

Figure 1:
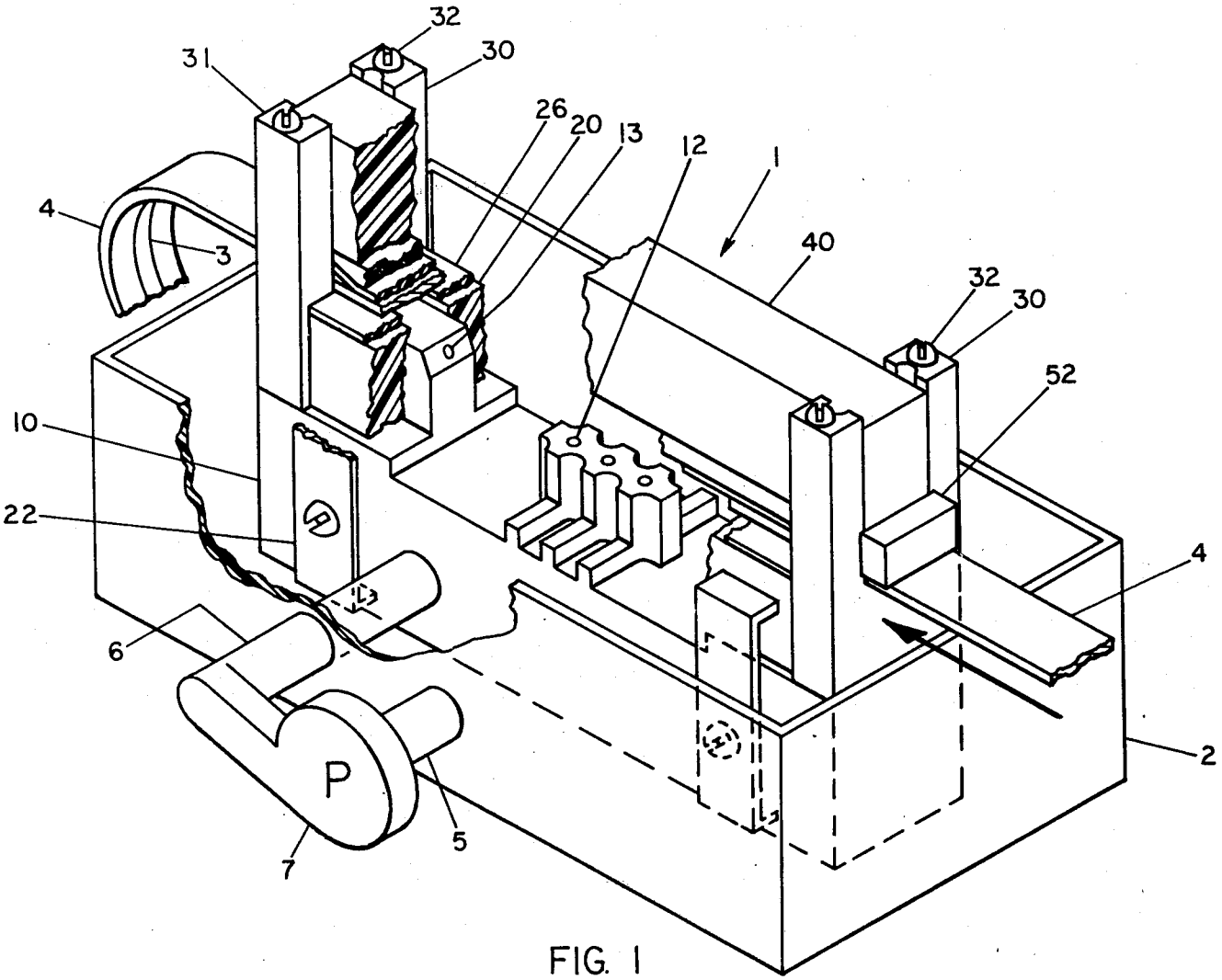
FIG. 1 is a perspective view of an apparatus according to the present invention.
Figure 2:
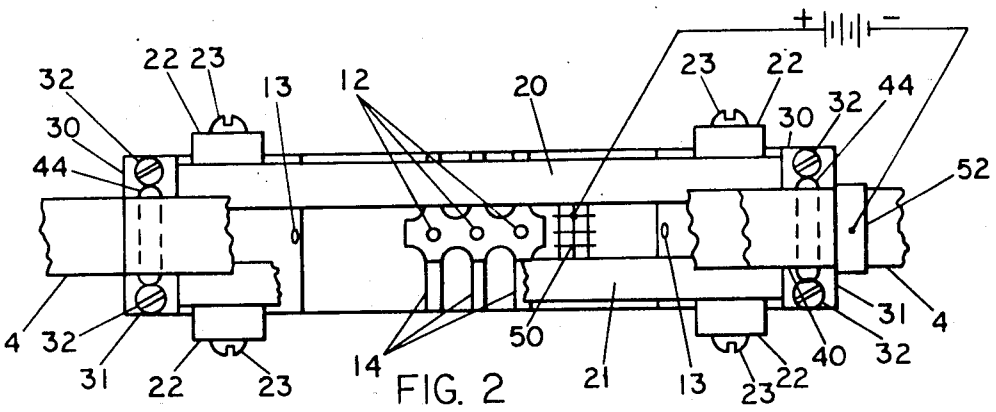
FIG. 2 is a partial cut-away plan view of the apparatus of FIG. 1.

Referring to the drawings and in particular to FIG. 1, there is provided in accordance with the present invention an apparatus 1 mounted in a fluid container 2 for plating a stripe 3 on a strip 4. Extending between the bottom of container 2 and the apparatus 1 is a pair of pipes 5 and 6 and a fluid pump 7 for recirculating fluid in the container through the apparatus.

Figure 3:
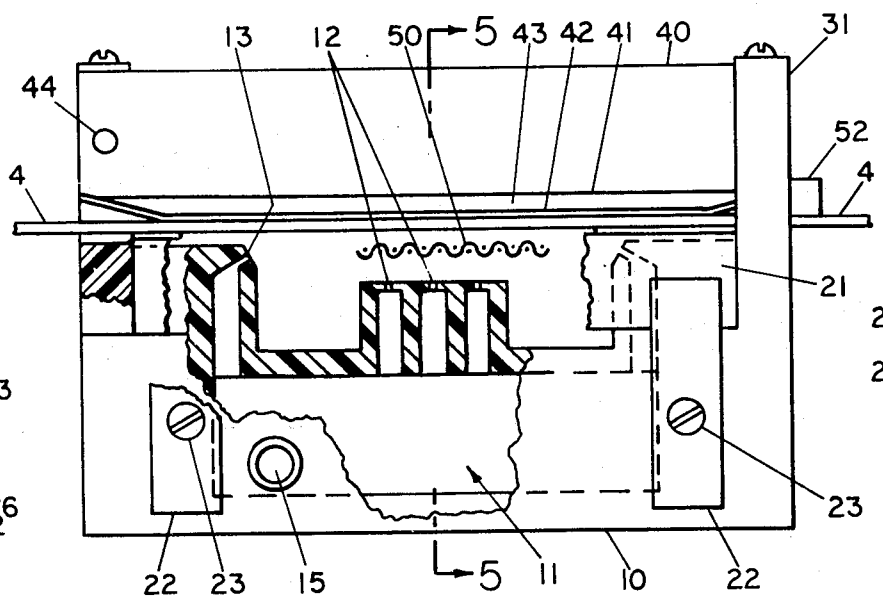
FIG. 3 is a partial cut-away elevation view of the apparatus of FIG. 2.
Figure 4:
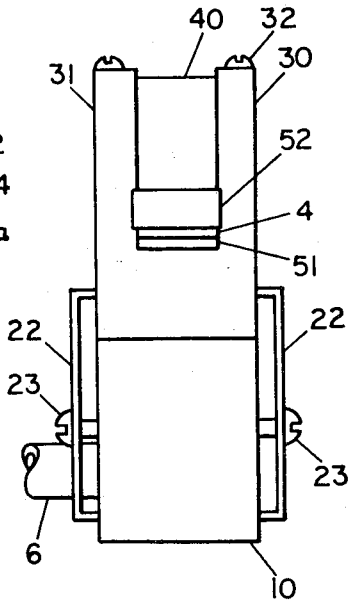
FIG. 4 is an end view of FIG. 3.
Figure 5:
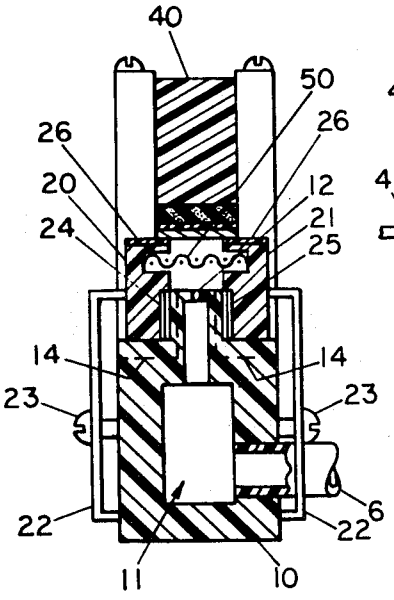
FIG. 5 is a cross-sectional view taken along lines 5—5 of FIG. 3.

As shown in more detail in FIGS. 3 and 5, apparatus 1 comprises a base member 10. In base member 10, there is provided a fluid manifold 11 which is coupled to the pipe 6 by means of a fluid input port or channel 12.

Along a line in an extended portion of the upper surface of manifold 11 there is provided a plurality of fluid jets 12, 12 . . . Each of the jets 12, 12 . . . is formed by the provision of a relatively small hole in the extended portion of the upper surface of the manifold for providing a fluid passageway from the interior thereof. On opposite ends of the jets 12, 12 . . . there is provided a jet 13 which is also provided to be in fluid communication with the manifold 11. Jets 12, 12 . . . are provided to jet fluid vertically. Jets 13, 13 are orientated to direct fluid inwardly. The number of jets 12, 12 . . . may vary depending on the size of the apparatus and, of course, more than a single jet 13, 13 may be employed on opposite ends of the jets 12, 12 . . . for jetting fluid inwardly. In addition, there is provided, between the jets 12, 12 . . . and 13, 13 a plurality of fluid discharge ports 14 for discharging fluid from the jets into the container 2.

Extending in parallel along opposite sides of jets 12, 12 . . . and 13, 13 is a pair of spaced rail members 20 and 21 which are movably attached to base member 10 by means of a plurality of brackets 22, 22 . . . Brackets 22, 22 . . . are attached to base member 10 by screws or the like 23, 23 . . . Removably fitted between rails 20 and 21 are shims 24 and 25. As will be apparent, shims 24 and 25 are removable to enable selective adjustment of the spacing between the rails when a change in stripe width is made. Fixed to the top of each of the rails 20 and 21 is a film 26 of a material having a relatively low coefficient of friction.

At opposite ends of the rails 20 and 21 there is provided a pair of upstanding spaced posts 30 and 31 which are movably attached to the base member 10 as by screws 32. Posts 30 and 31 are provided for guiding the strip 4 through the apparatus 1 and for controlling the position of the stripe 3 on the stip.

Movably mounted between the posts 30 and 31 is an elongated bar-like member 40 having a bottom surface 41. Covering the surface 41 is a web of material 42 having a low coefficient of friction. The web 42 and the film 26 on top of the rails 20 and 21 are provided for providing a low friction surface to interface with the strip 4. Between the web 42 and surface 41 there is provided a resilient sponge-like material 43. Material 43 serves to cushion the member 40 on the strip 4 and to distribute the weight of the member more uniformly over the surface of the strip. At opposite ends of the member 40, there is provided a plurality of bearing members 44. Members 44 interface with the posts 30 and 31 so as to prevent longitudinal movement of the member 40 relative to the posts while at the same time allowing unrestricted vertical movement of the member relative thereto.

The apparatus 1, as described above, may be used to continuously deposit a stripe of a first material on the strip comprising a second material by forcing a fluid containing the first material through the jets 12, 12 . . . and 13, 13 onto the underside of the strip 4. As thus described, the apparatus 1 may be used for depositing a wide variety of materials on a strip.

Referring to FIGS. 1 and 3, for the electrodeposition of a metal, such as gold, on the strip 4 there is further provided an electrode 50. Electrode 50 is preferably a screen made of metal, such as platinum, which is insulatingly mounted between the rails 20 and 21 approximately midway between the strip 4 and jets 12, 12 . . . In sliding contact with the strip 4 there is provided an electrode 52. The positive side of a source of potential, represented by a battery B in FIG. 1, is coupled to the electrode 50 in any suitable manner while the negative side of source B is coupled to the strip 4 by means of the electrode 52. The source B and the electrodes 50 and 52 provide a suitable current in the plating solution for plating the strip 4.

In operation, as seen in FIG. 1, the strip 4 enters the apparatus at one end and exits from the opposite end with a stripe of the desired material deposited on its underside. In the process of electrodepositing gold on the strip 4, the container 2 is filled with a solution containing gold. The solution is pumped by the pump 7 from the container into the manifold 11 wherein it is distributed to each of the jets 12, 12 . . . and 13, 13. The jets 12, 12 . . . jet the fluid from the manifold 11 perpendicularly against the underside of the strip 4. The jets 13, 13 jet fluid inwardly toward the intermediate jets against the back-spray from the strip 4. This has the effect of containing the fluid between the rails 20 and 21 and preventing its escape through a pair of holes 51 located at opposite ends of the rails. The holes 51 prevent the solution from being spread like a squeeze over the masked areas and prevent marring the plated portion of the strip. After the fluid strikes the strip 4, the spent fluid is allowed to drain unrestrictedly through the fluid discharge ports 14 and into the container 2.

As the strip 4 is transported through apparatus 1 by any conventional means, not shown, the member 40 bears down on the strip for maintaining a fluid-tight seal between the lateral edges of the strip and the top of the rails. The weight of member 40 is chosen preferably to be as small as possible while still being sufficient fo form the above described seal. As an alternative, an air cylinder or bladder with an air pressure regulator may be used to supply the force rather than the weight. The low friction material on the member 40 and rails 20 and 21 further facilitates the ease with which the strip is transported through the apparatus while the sponge-like material 43 on the underside of the member 40 serves to distribute its weight uniformly over the surface of the strip. When electrodepositing metals, an electric field is further provided between the electrode 50 and strip 4 by means of the electrode 52. Typically, the electrode 50 is used as an anode and the strip to be plated is the cathode. It may be noted at this point that any voids caused by the presence of the screen 50 in the fluid path from the jets 12, 12 . . . are eliminated as and because the strip 4 in the preferred operation of the apparatus is transported continuously through the apparatus during the plating process.

It may be noted at this point that the bulk of the apparatus described is fabricated from electrically nonconductive material which is not affected by the plating bath. Those parts, such as electrode 50, which are required to be made of metal, are made of platinum or the like, which is compatible with the bath.

Whenever it is desired to change the width of the stripe or the position of the stripe deposited on the strip, the relative position of the rails 20 and 21 and the position of the terminal strip guiding posts 30 and 31 relative to the rails are changed.

The width of the stripe is changed by loosening the brackets 22 and removing or inserting shims 24 and 25 depending on whether the width of the stripe is to be decreased or increased. The position of the stripe on the strip may also be adjusted to a degree by shifting the position of the shims 24 and 25 from one side of the jets to the other. Additionally, the position of the stripe on the strip is changed relative to the lateral edges of the strip by loosening the posts 30 and 31 and shifting them right or left relative to the rails 20 and 21.

It is apparent that other arrangements of and modifications to the rails 20 and 21, and posts 30 and 31 may be employed for providing the described adjustability of stripe width and position. Likewise, the member 40 may be either a solid member, hollow container, air bladder or cylinder in which is inserted sufficient weight or pressure to provide the necessary fluid-tight seal between the strip and the rails. Clearly, still other changes will occur to those skilled in the art without departing from the spirit and scope of the present invention.

Accordingly, it is understood that the above described apparatus is intended only as a preferred embodiment of the present invention and that the true scope of the invention should not be limited thereto but construed by reference to the claims and their equivalents hereinafter provided.

What is claimed is:

1. A method of plating a stripe of a first material on a strip of a second material comprising the steps of:

transporting said strip continuously over a void having a predetermined length and width while maintaining a fluidtight seal between said strip and the edges of said void; jetting a fluid containing said first material substantially perpendicular to said strip face against said strip along a central portion in said void for a predetermined length thereof; and jetting a fluid containing said first material inwardly in said void from positions at opposite ends of said predetermined length for preventing the escape of spent fluid from said void.

2. A method according to claim 1 further comprising the step of providing an electric field in the fluid jetted against said strip along said predetermined length of said strip.

3. A method according to claim 2 further comprising the steps of changing the width and position of said stripe on said strip by changing, respectively, the width of said void and the position of said strip relative to said void.

* * * * *